US006131230A

United States Patent [19]

Manabat

[11] Patent Number: 6,131,230

[45] Date of Patent: Oct. 17, 2000

[54] PORTABLE RAZOR CLEANING AND HOLDING APPARATUS

[76] Inventor: Gregorio S. Manabat, 7262 Melrose St., Suite 313, Buena Park, Calif. 90621

[21] Appl. No.: 09/268,857

[22] Filed: Mar. 15, 1999

[51] Int. Cl.[7] ..... A46B 11/00; A46B 13/08

[52] U.S. Cl. ..... 15/104.92; 15/21.1; 15/88.4; 15/160; 401/10

[58] Field of Search ..... 15/21.1, 38, 39, 15/88.4, 104.92, 160; 401/9, 10

[56] References Cited

U.S. PATENT DOCUMENTS

| | | | |
|---|---|---|---|
| 1,366,306 | 1/1921 | Wick | 15/21.1 X |
| 1,542,025 | 6/1925 | Ballman | 15/38 |
| 2,036,840 | 4/1936 | Thiesen | 15/39 |
| 2,478,522 | 8/1949 | Buskirk | 15/104.92 X |
| 2,704,374 | 3/1955 | Barklow | 15/39 |
| 2,771,621 | 11/1956 | Erickson | 15/167.1 X |
| 3,761,984 | 10/1973 | Hauschild et al. | 15/39 X |
| 4,510,954 | 4/1985 | Miller | 15/88.4 X |
| 4,676,839 | 6/1987 | Osborn | 15/21.1 X |
| 4,872,232 | 10/1989 | Stiasny | 15/88.4 |
| 4,890,348 | 1/1990 | Racioppi | 15/160 |
| 4,944,063 | 7/1990 | Jordan | 15/104.92 |
| 4,945,598 | 8/1990 | Racioppi | 15/160 |
| 5,426,806 | 6/1995 | Johnson et al. | 15/88.4 |
| 5,560,066 | 10/1996 | McDivitt | 15/21.1 |

FOREIGN PATENT DOCUMENTS

| | | | |
|---|---|---|---|
| 540471 | 12/1931 | Germany | 15/38 |
| 341405 | 6/1936 | Italy | 15/39 |

*Primary Examiner*—Mark Spisich
*Attorney, Agent, or Firm*—James G. O'Neill

[57] ABSTRACT

A device for easily and quickly cleaning safety razors is provided with a housing having a top portion with an elongated slot having a brush adjacent thereto and a hollow bottom portion having a fluid reservoir formed therein. A cleaning wall may be formed in the fluid reservoir over which the brush may be passed for cleaning thereof, by actuation of an external handle.

15 Claims, 6 Drawing Sheets

PORTABLE RAZOR CLEANING AND HOLDING APPARATUS

BACKGROUND OF THE INVENTION

1. Field of the Invention

This invention relates generally to cleaning devices, and, more particularly, to a novel cleaning and holding device for safety razors.

2. Description of Related Art

Modern safety razors having one, two or three blades, are widely used by both men and women for shaving. Such safety razors, however, are somewhat difficult to clean because of the close proximity of the face guard and the one or more blade edges. Furthermore, because of the way the handle is attached to the head of such razors, debris may be caught in and around the head. To clean known safety razors, a user will hold the safety razor under a flow of hot water, in an attempt to dislodge any material on the razor head held within the gaps between the blade edges, the face guard and in other areas. When two or more blades are used in such safety razors, the difficulty associated with cleaning the blades is increased dramatically. The edges of such multiple blades are staggered and materials are easily trapped between the blades, where it is difficult to dislodge. Therefore, a user usually shakes the razor and/or uses more hot water in an attempt to clean these newer type safety razors. These attempts are usually futile, waste water and frustrate users.

Manufacturer's have recognized the problems associated with cleaning the areas between adjacent blade edges, and have provided thin sheets of flexible material and even brushes, for use in cleaning the same. Additionally, known prior art cleaning devices for safety razors are disclosed in U.S. Pat. Nos. 4,890,348 ("'348") and 4,945,598 ("'598") to Racioppi. Both of these patents show a razor cleaning device, having a suction cup base, which supports a stem having a cleaning head with a plurality of bristles thereon. In the '348 patent, the bristles are preferably formed at an angle to the head and the suction cup is secured on the crown of a pop-up drain stopper so that water coming from a faucet may be run across the razor being cleaned on the bristles of the brush. In contrast to the '348 patent, the '598 patent is for use in a bathtub or shower enclosure, wherein the suction cup is secured to a wall with the bristles pointing upwardly. Adjacent to the cleaning head, there is provided a U-shaped, or other holding device, for supporting a razor when not being cleaned or used. Both of these brushes require side-to-side motion in a wiping plane, usually while running water is present, and force a user to hold an edge of a razor being cleaned at the angle of the brushes so as to ensure that none of the bristles on the brushes are cut or otherwise damaged.

Although they provide improvements in the art, none of the known devices are capable of being easily moved, or supported on the top of almost any flat surface, without removing a suction cup or other portion thereof, and then used to quickly and safely clean a safety razor. Therefore, there exists a need in the art for an inexpensive, easy-to-use and manufacture razor cleaning device that may be supported on substantially any flat surface, and which allows a safety razor to be easily cleaned therein by movement back and forth, along a guided path, and which device may be easily cleaned to overcome problems of health and hygiene.

The novel and simplified device of the present invention provides improvements in the art, and allows a user to easily and quickly clean a safety razor by drawing or moving the safety razor back and forth within a slot formed in the top of a housing having a fluid reservoir, and which includes a rotatable brush. The brush may be cleaned by actuating a handle to move the brush up and down across a roughened surface within a cleaning and/or anti-bacterial solution.

SUMMARY OF THE INVENTION

Accordingly, it is a general object of the present invention to provide an improved safety razor cleaning device. It is a particular object of the present invention to provide an improved safety razor cleaning and holding device. It is a still more particular object of the present invention to provide an improved safety razor cleaning and holding device having an elongated brush held within a housing containing a cleaning and/or anti-bacterial solution. It is a still more particular object of the present invention to provide an improved safety razor cleaning and holding device having a pleasing and aesthetic design with an open slot for guiding a razor to be cleaned along an elongated cleaning brush. And, it is yet a still further particular object of the present invention to provide an improved safety razor cleaning device having housing which will support a safety razor, when not in use, and which housing contains an access opening and an elongated rotatable cleaning brush, together with a reservoir for cleaning fluid having an internal roughened wall which is used to clean the elongated cleaning brush upon actuation of a handle.

The above-set forth objects are accomplished by providing a housing having a substantially rectangular lower portion and an upper portion with an access slot formed therein. The access slot is used to guide a safety razor head inserted therein along the length of the elongated cleaning brush. A reciprocally mounted handle is secured to the brush for actuation into and out of a reservoir held within a hollow inner chamber formed in the lower portion. The hollow inner chamber includes a roughened wall over which the elongated brush travels, so as to be cleaned upon actuation of the handle.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved safety razor cleaning and holding apparatus or device 10.

Figure 7:
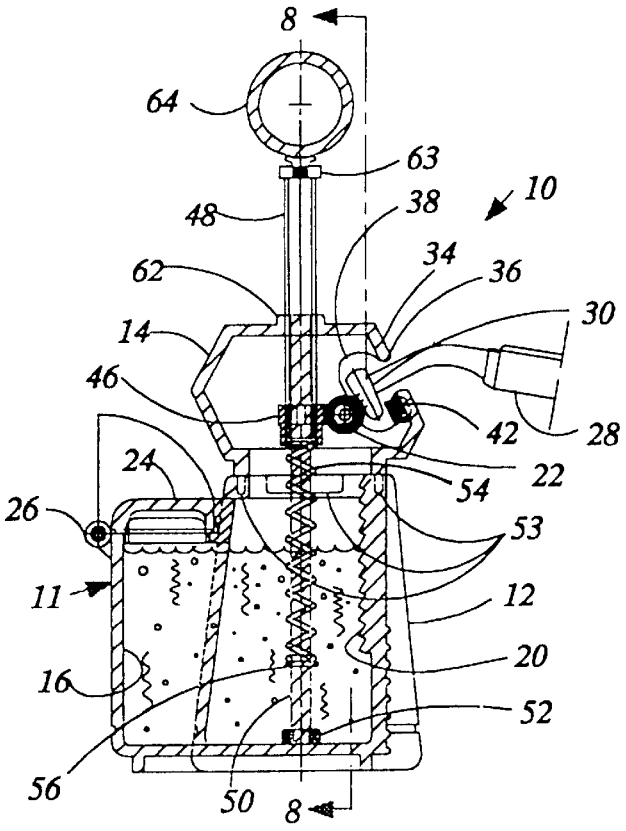
FIG. 7 is a cross sectional view taken along line 7—7 of FIG. 1, showing a partial safety razor in the cleaning position in broken line.
Figure 10:
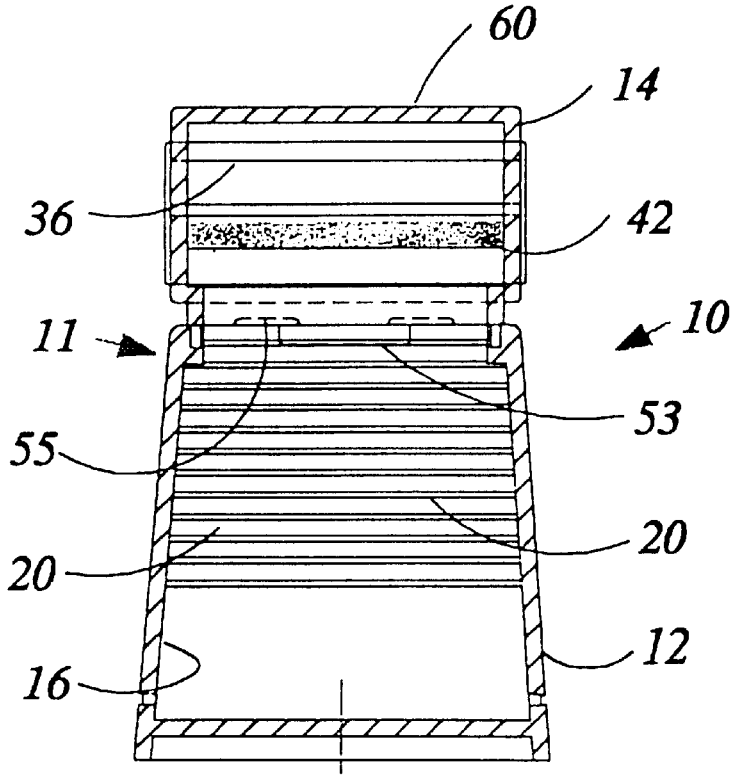
FIG. 10 is a cross sectional view taken along line 10—10 of FIG. 9.
Figure 11:
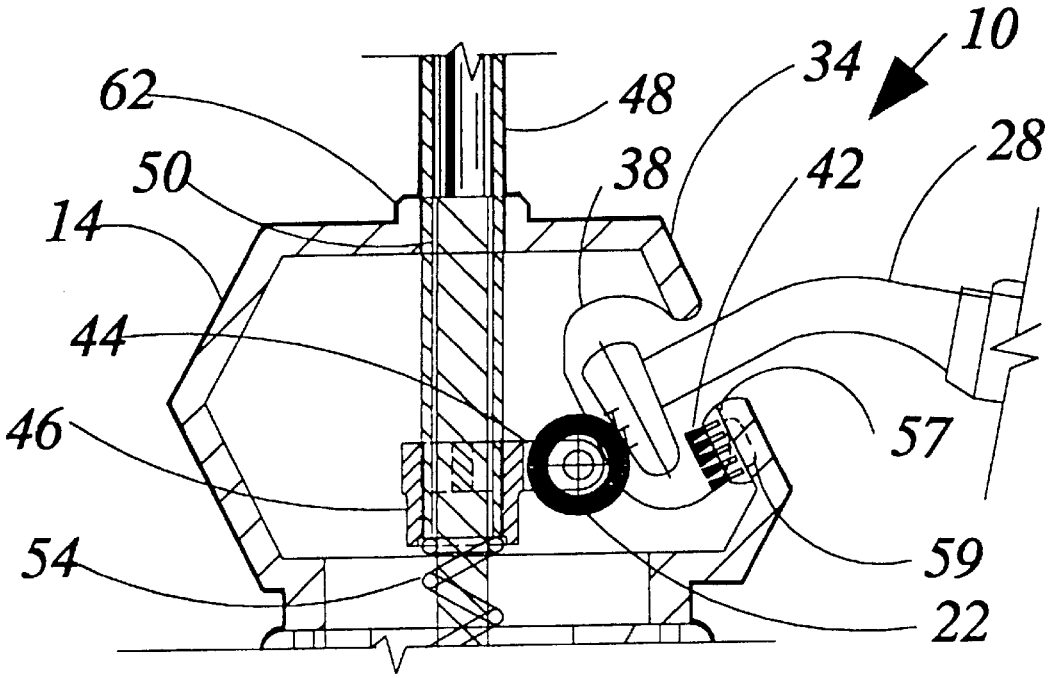
FIG. 11 is an enlarged partial cross-sectional view of the top cleaning portion of the present invention.

As shown in the drawings, although the apparatus 10 of the present invention may take any desired shape, and be made from any available or desired material, it is preferably formed as a rectangular body or housing 11, from plastic or other similar material. In the preferred embodiment shown in the drawings, the body 11 includes a main or lower portion 12 having removably secured thereto a top or head portion 14. The lower portion 12 is hollow and includes an internal chamber or reservoir 16 having a cleaning and/or anti-bacterial fluid 18 contained therein (see FIGS. 7 and 8). Furthermore, as best shown in FIGS. 7 and 10, an interior wall 20, having a rough or serrated surface, is provided on one side of the reservoir 16 to enable a cleaning brush 22 to be cleaned thereon, as explained more fully below. The cleaning and/or anti-bacterial fluid 18 is placed in and removed from the reservoir 16 by means of a cap or closure 24 rotatably mounted around one or more hinge elements 26. A safety razor 28 having a head 30 may be held on or supported in the lower portion 12 by means of a clip or other holding element 32, secured on one side of the lower portion.

Figure 1:
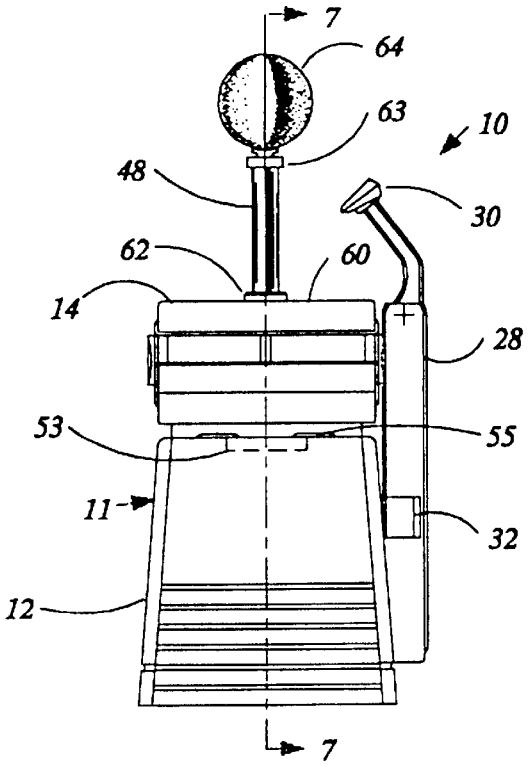
FIG. 1 is a front elevational view of a safety razor cleaner and holder of the present invention.
Figure 2:
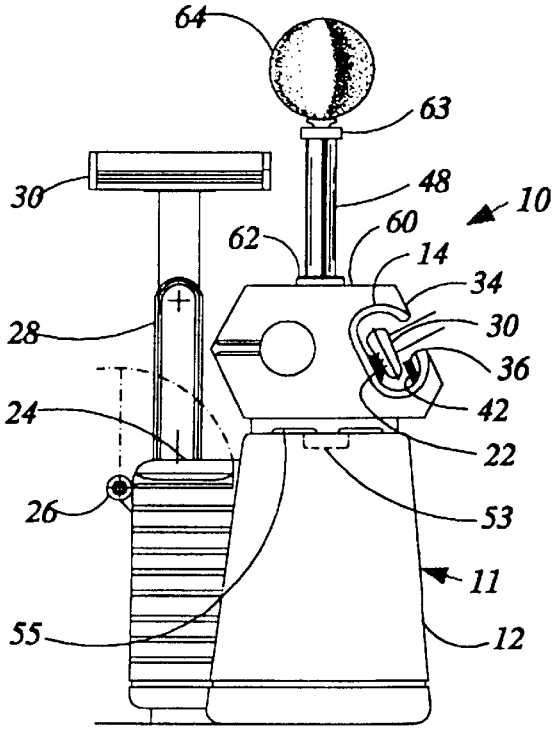
FIG. 2 is a left side elevational view of the safety razor cleaner and holder shown in FIG. 1.
Figure 3:
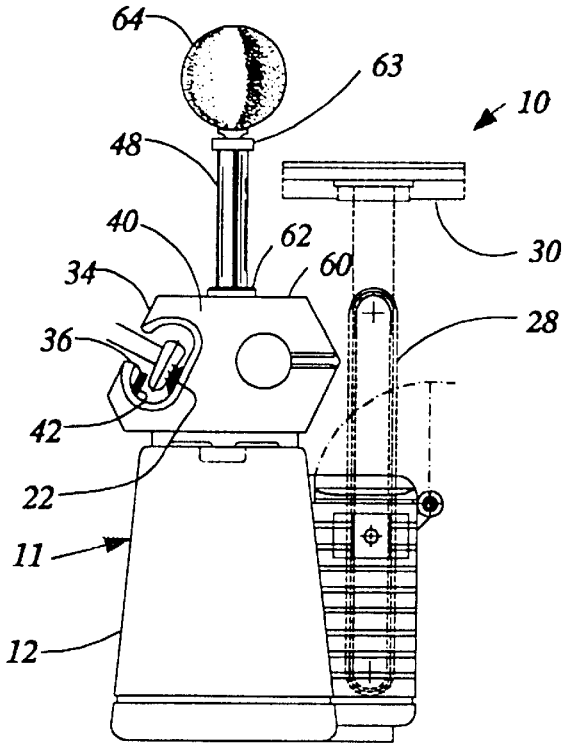
FIG. 3 is a right side elevational view of FIG. 1.
Figure 4:
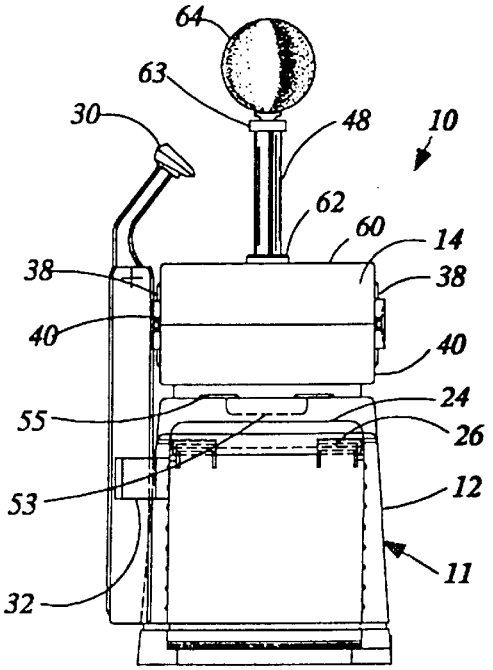
FIG. 4 is a rear elevational view of FIG. 1.
Figure 5:
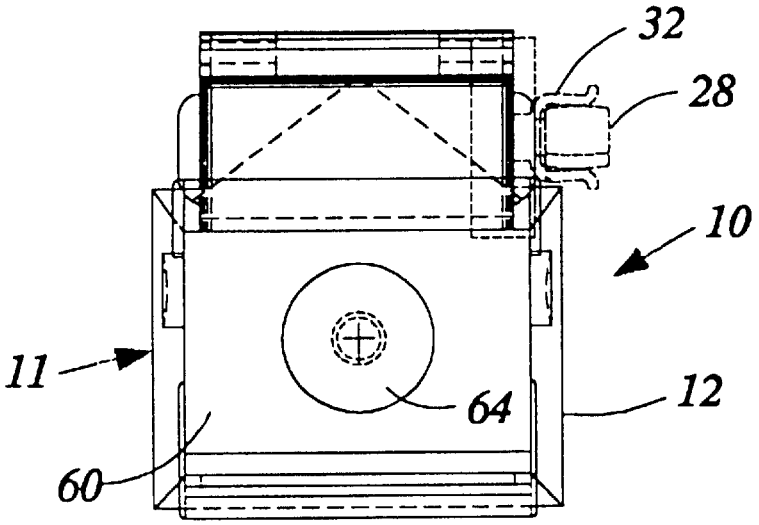
FIG. 5 is a top plan view of FIG. 1.
Figure 6:
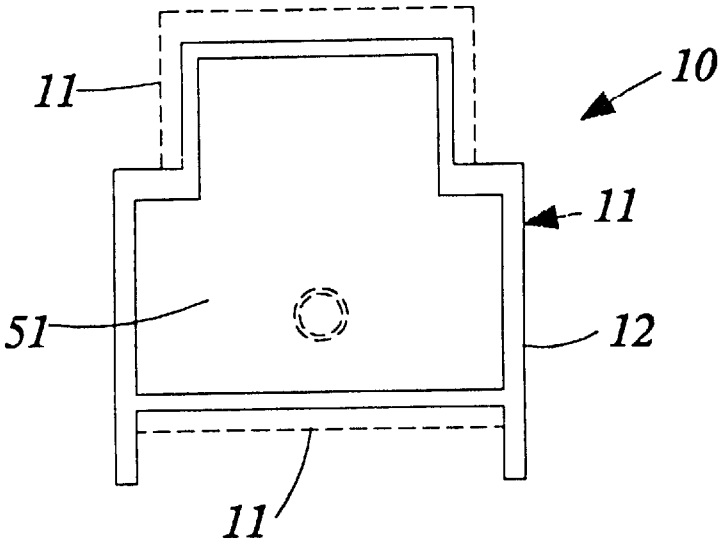
FIG. 6 is a bottom plan view of FIG. 1.

Turning to FIGS. 2, 3 and 7, as there shown, a front face 34 of the head 14 is formed at an angle or slanted with respect to a top surface. An elongated aperture or slot 36 is formed in the angled, slanted face 34, and is shown connected to or between aligned end apertures or oval openings 38 formed in end walls 40 at opposed ends of the head 14. Also, shown in FIGS. 7, 9, 10 and 11, a means for cleaning 42, such as a second elongated brush, is removably mounted on an interior surface of the angled or slanted face 34, adjacent an edge of the elongated aperture 36, to aid in cleaning the lower portion of the head 30 of a safety razor contacting the same.

Figure 8:
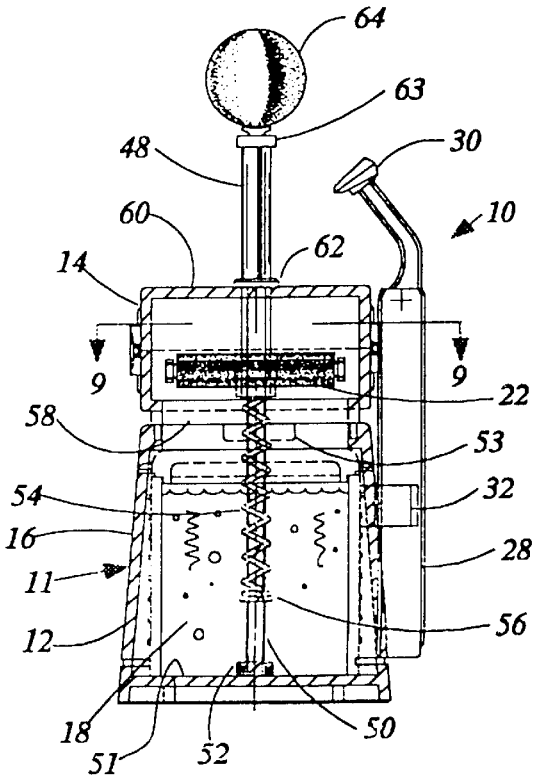
FIG. 8 is a partial cross sectional view taken along line 8—8 of FIG. 7 with the safety razor shown held in a clamp on the side thereof.
Figure 9:
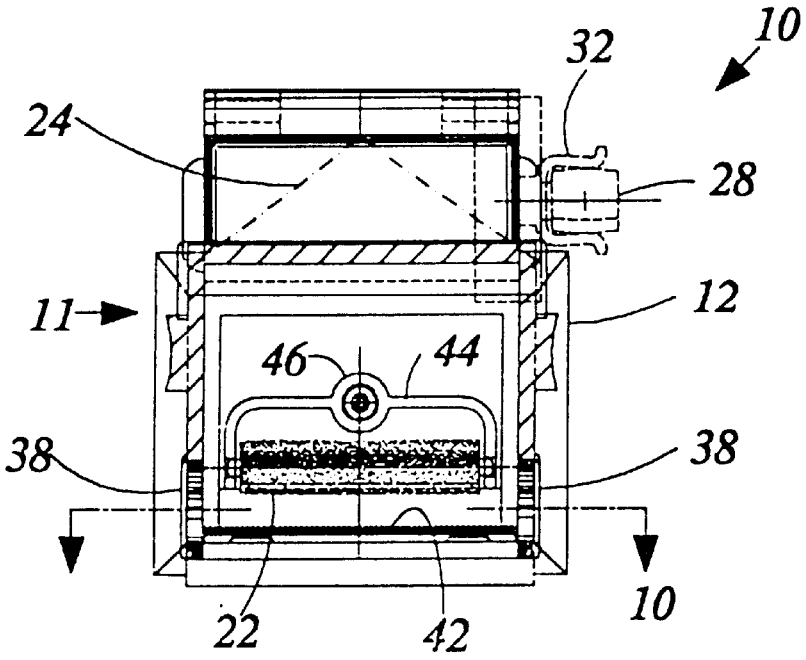
FIG. 9 is a cross sectional view taken along line 9—9 of FIG. 8.

To clean a safety razor 28, and, in particular, the head 30 thereof in the device of the present invention, the head 30 of the safety razor 28 is inserted in the elongated slot 36 at either of the oval end openings 38 formed in the opposed walls 40 of the head 14. The safety razor is then drawn or pulled along the aperture 36, with the head 30 maintained in position against cleaning brush 22, from one side or end wall 40 to the other, as many times as desired. The head 30 is preferably pressed against the bristles of the elongated brush 22, but, if desired, may only rest lightly against the bristles during cleaning. If the brush 42 is provided on the interior surface of the angled face 34, a lower portion of the head 30 of the safety razor being cleaned will be pressed against this brush for cleaning thereof. The brush 22, as shown more clearly in FIGS. 8 and 9, is preferably an elongated cylinder having a plurality of short bristles made from nylon, or the like, thereon. The elongated, cylindrical brush 22 is rotatably mounted in a U-shaped bracket or holding element 44 (see FIG. 9). The U-shaped holding element 44 includes a central cylindrical portion 46 which is secured to an elongated tubular element or shaft 48 carried on a rod 50, secured to a bottom 51 of the reservoir 16 and body 11, by any desired attachment element 52, such as a nut. The tubular element 48 is normally held in a raised position, as shown in FIGS. 1–4, 7 and 8, by the action of a spring 54, or similar type biasing means, held between an anchoring or holding element 56, such as a pin, washer or the like, secured on rod 50, above the bottom 51, and an upper anchoring element 58, such as a washer, an end of the central cylindrical portion 46, or a lower end of the tubular element 48.

A flat top surface or wall 60 of the head 14 includes an opening 62 formed centrally thereof, and an upper or outer end 63 of tubular element 48 includes a handle or operating element 64 secured thereto. The handle 64 may be in the shape of a ball, or the like. The entire head 14 may be removed by releasing a male/female portion 55 from a groove or quirk 53.

The operation of the apparatus 10 of the present invention will now be explained in more detail. As explained above, the head 30 of a safety razor 28 is inserted in the elongated slot 36 through either end aperture 38. When inserted in the slot 36, the safety razor head 30 will be supported at the proper angle to allow the head to be positioned against the elongated cylindrical brush 22 at a preferred angle, so as to more thoroughly clean the head 30 and any blades therein, as the head 30 is moved along the slot 36, in both directions. If the brush 42 is held within the interior wall, as by means of a male/female portion 57, held in a groove or quirk 59, the lower portion of head 30 will also be cleaned. After cleaning, the head 30 is removed from either end aperture 38, and may be stored in clip 32.

After cleaning the head 30 of a safety razor, the elongated brush 22 may be cleaned be actuating the handle 64. That is, by pushing down on the handle 64, the tubular sleeve 48 will be pushed against the resistance of spring 54, to move the rotatable brush 22 down into the reservoir 16 and cleaning fluid 18. When the rotatable brush contacts the roughened or serrated surface of inner wall 20, the roughened surface will aid in cleaning the brush 22, while, at the same time, rotating the brush in the cleaning solution 18. The cleaning solution 18 may be changed, as needed, in accordance with the wishes of the user. The brush 42 may be replaced if worn, or too dirty to clean.

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A portable safety razor cleaning and holding device, comprising:

a body having a hollow lower portion and a hollow head portion;

the hollow lower portion including a fluid holding area with a cleaning fluid therein;

the hollow head portion having an access area comprised of an elongated slot with a pair of end apertures and an elongated, cylindrical brush for cleaning safety razor heads held therein, adjacent the access area; and means for moving the elongated, cylindrical brush.

2. The portable safety razor cleaning and holding device of claim 1 wherein the hollow head portion includes an angled face, and the elongated slot is formed in the angled face.

3. The portable safety razor cleaning and holding device of claim 2, further including a second elongated brush element secured to an interior surface of the angled face, adjacent a side edge of the elongated slot.

4. The portable safety razor cleaning and holding device of claim 1 wherein the means for moving the elongated, cylindrical brush is an operating handle secured to a connecting element passing through the hollow head portion and operatively connected to the elongated, cylindrical brush.

5. The portable safety razor cleaning and holding device of claim 4, further including a roughened wall in the fluid holding area.

6. The portable safety razor cleaning and holding device of claim 5 wherein the operating handle is actuated to move the elongated, cylindrical brush into contact with the roughened wall to clean the elongated, cylindrical brush.

7. The portable safety razor cleaning and holding device of claim 6, further including a holding clip for holding a safety razor to the hollow lower portion.

8. The portable safety razor cleaning and holding device of claim 7 wherein the hollow head portion includes a substantially flat top and an angled face, and the access area is formed in the angled face.

9. The portable safety razor cleaning and holding device of claim 8 wherein the pair of end apertures are elliptical.

10. The portable safety razor cleaning and holding device of claim 9, further including a second elongated brush element secured to an interior wall of the angled face, for cleaning a portion of a safety razor head.

11. A portable safety razor cleaning device, comprising:

a hollow body having a head portion connected to a lower portion;

the lower portion including an opening for inserting fluid into and taking fluid out of a reservoir formed in the lower portion;

a serrated wall in the reservoir;

an elongated slot formed across a face portion of the head portion;

the elongated slot having open ends;

a cylinderical, elongated brush held in the head portion, spaced from the elongated slot, between the open ends; and an external operating handle operatively connected to the cylindrical, elongated brush to move the cylindrical, elongated brush across the serrated wall to clean the cylindrical, elongated brush.

12. The portable safety razor cleaning device of claim 11 wherein the face portion is angled with respect to a flat top portion of the head portion, and the external operating handle includes a ball-shaped holding element secured to a tubular element that extends through an opening in the flat top portion and is connected to a bracket on which the cylindrical, elongated brush is rotatably mounted.

13. The portable safety razor cleaning device of claim 11, further including a holding clip mounted on an external wall of the lower portion for removably holding a safety razor therein.

14. The portable safety razor cleaning device of claim 11, further including a second elongated brush secured to an internal wall of the face portion, adjacent a side edge of the elongated slot.

15. A portable safety razor cleaning and holding device, comprising:

a housing having a hollow lower body and a hollow upper head secured together so as to form an interior reservoir for holding a cleaning fluid;

the hollow upper head including a flat top wall, an angled front face and two substantially flat side walls;

an elongated slot formed in the angled front face and connected to aligned oval, open apertures formed in the two substantially flat side walls;

a cylindrical, elongated brush, rotatably mounted in the hollow, upper head, spaced from the elongated slot to enable a safety razor head inserted in one of the aligned oval, open apertures to be cleaned by movement along the elongated slot and the cylindrical, elongated brush; and an operating handle operatively connected to the cylindrical, elongated brush through an opening formed in the flat top wall, to move the cylindrical, elongated brush into and out of contact with a serrated wall formed in the reservoir to clean the cylindrical, elongated brush.

* * * * *